United States Patent [19]

Ford

[11] 4,123,127

[45] Oct. 31, 1978

[54] ARTIST'S KIT

[76] Inventor: Thomas E. Ford, 150-24 6th Ave., Whitestone, N.Y. 11354

[21] Appl. No.: 789,115

[22] Filed: Apr. 20, 1977

[51] Int. Cl.[2] ..... A47B 27/00

[52] U.S. Cl. ..... 312/230; 312/231; 312/233; 312/237

[58] Field of Search ..... 312/230, 231, 281, 233, 312/237

[56] References Cited

U.S. PATENT DOCUMENTS

| | | | |
|---|---|---|---|
| 654,841 | 7/1900 | MacDonald | 312/231 |
| 1,065,255 | 6/1913 | Kuhrt | 312/231 |
| 2,638,297 | 5/1953 | Wykoff | 312/231 |
| 2,680,932 | 6/1954 | Rotschild | 312/231 |
| 2,751,271 | 6/1956 | Dessertenne et al. | 312/231 |
| 3,031,247 | 4/1962 | Schieve | 312/231 |
| 3,476,456 | 11/1969 | Canavan | 312/231 |

*Primary Examiner*—Victor N. Sakran

[57] ABSTRACT

An artist's kit for use with an easel comprising a rectangular box having a base and a front wall, a rear wall and side walls all disposed substantially perpendicular to the base. A cover is pivotally mounted to the box for movement from a closed position to an open position wherein the plane of the cover is substantially parallel to the base of the box. The cover can be releasably locked in the open position to form a rigid, open top tray assembly. The kit further comprises mounting members to releasably connect the rigid tray assembly to the legs of the easel during use.

12 Claims, 5 Drawing Figures

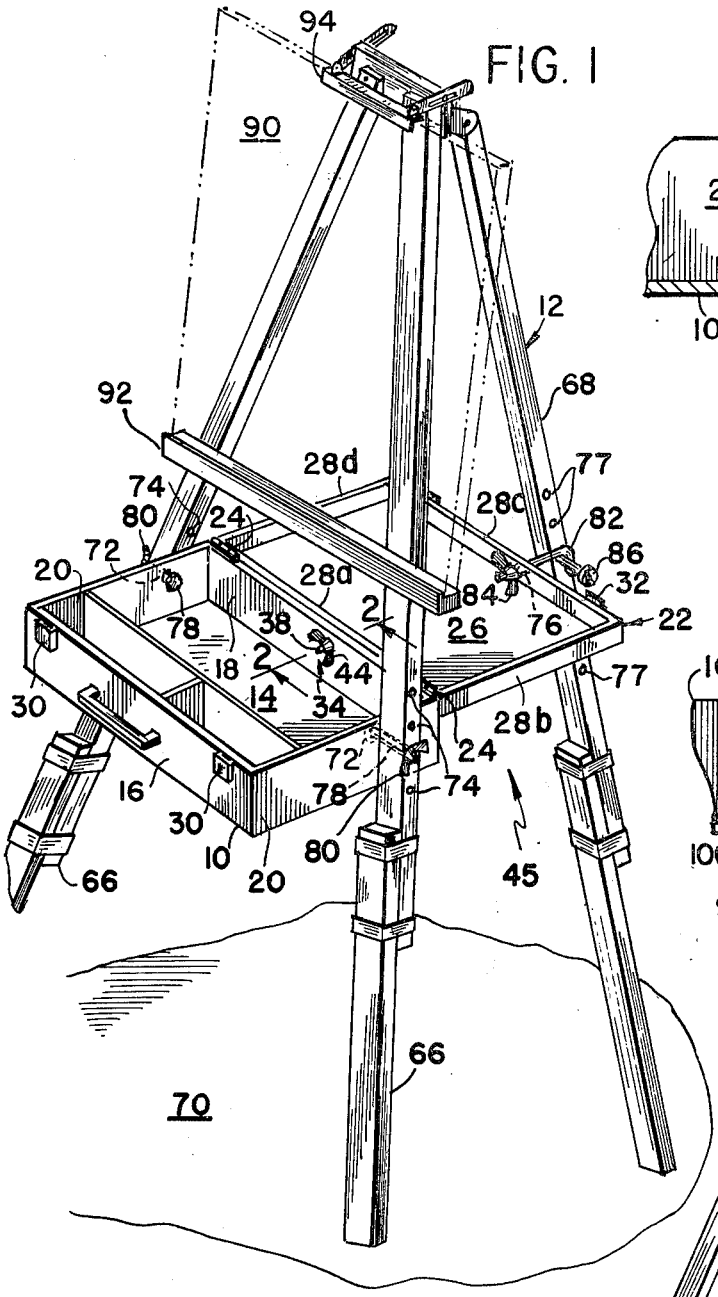
FIG. 1
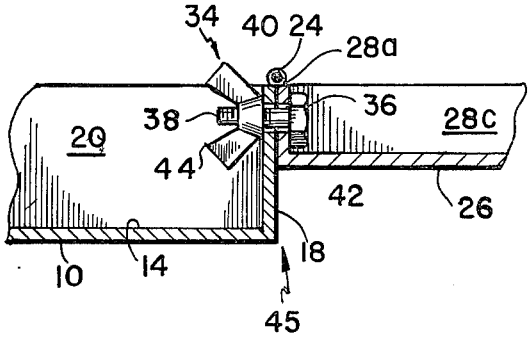
FIG. 2
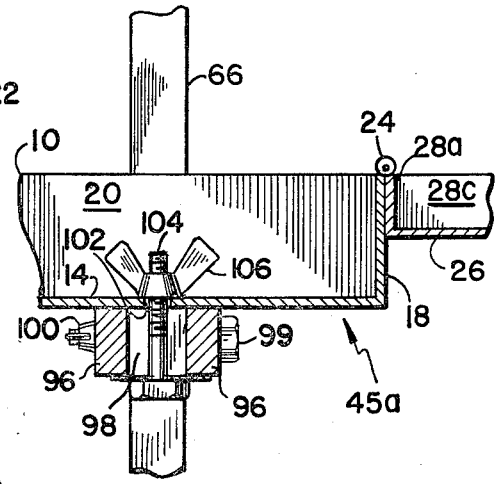
FIG. 4
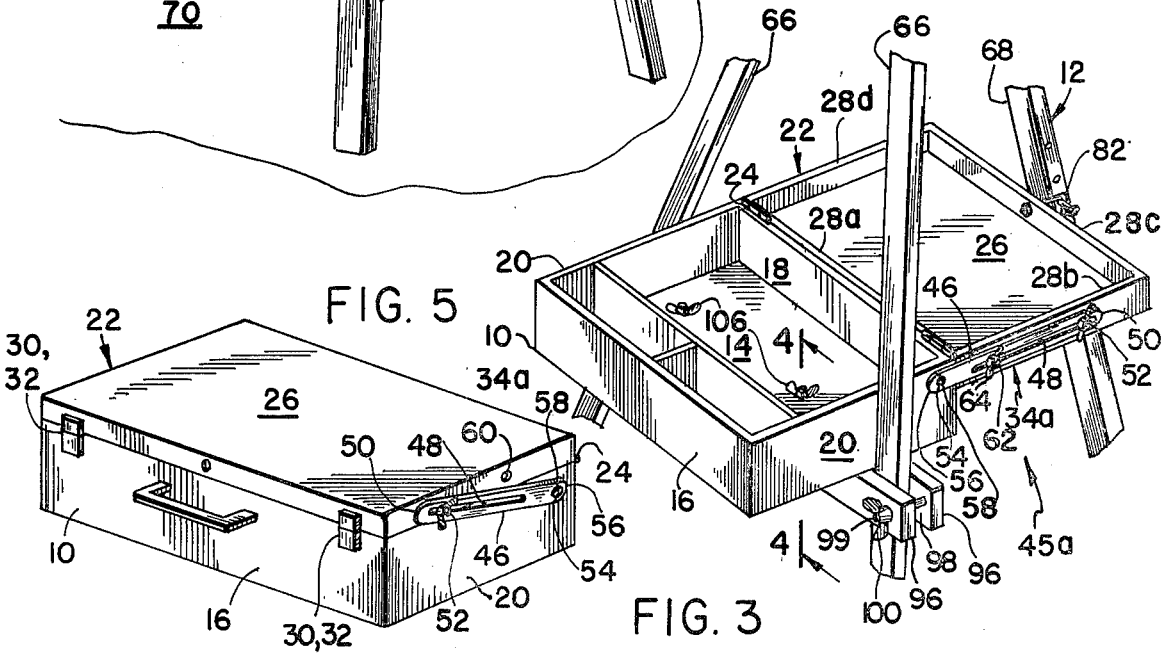
FIG. 3
FIG. 5

ARTIST'S KIT

BACKGROUND OF THE INVENTION

The present invention relates to artist's kits comprising a box and a cover portion and particularly an apparatus in which the cover may be locked with respect to the box to form a rigid tray assembly wherein the box and cover are disposed in parallel planes. The tray assembly can be connected to a standard tripod easel for use by the artist as a working surface while painting on a canvas that is supported on the easel in the usual manner.

Artist's kits that include easel and leg members are known in the prior art, but these devices are of specialized construction and of a configuration having the easel and legs incorporated into the box member. None of these kits comprise conventional members that are commercially available and may be modified for use separately or cooperatively by the means of the present disclosure.

Examples of prior art devices of the specialized construction include U.S. Pat. Nos. 654,841; 2,586,524; 2,751,271; 3,132,439; 3,168,363; 3,202,471; 3,514,173; 3,540,787, French Pat. Nos. 1,363,532; 1,450,682 and Austrian Pat. No. 87,537. None of the references discloses a separable easel and paint box.

SUMMARY OF THE INVENTION

It is the principal object of this invention to provide an artist's kit and easel that may be releasably clamped together to form a convenient working module for the artist where all his painting supplies and tools are within easy reach.

A further object is to provide releasable retaining members for holding the box and cover in a fully opened position to provide a rigid tray assembly having a large area for holding the artist's materials during use.

A still further object is to form a working module that does not preclude using the easel for holding the canvas by standard means and in the optimum position for painting.

A still further object is to design all the kit components so as to be formable from commercially available easels and artist's boxes and still allow these components to be used individually and in a standard way.

These and other objects are achieved by the preferred embodiment of the present invention which comprises a rectangular box for holding artist's materials. A cover is pivotally mounted to permit movement from a closed position to a fully opened position wherein the cover is disposed in a plane parallel to the box. Releasable locking members having portions attachable to portions of the box and the cover to retain the cover in the fully open position to define an open top and rigid tray assembly. The tray assembly is releasably mountable to the legs of the easel using threaded locking members in conjunction with hooking members.

Having in mind the above and other objects that would be obvious from an understanding of the disclosure, the present invention comprises a combination and arrangement of parts illustrated in the presently preferred embodiments of the invention which are hereinafter set forth in sufficient detail to enable those persons skilled in the art to clearly understand the function, operation, construction and advantages of it when read in conjunction with the accompanying drawing.

BRIEF DESCRIPTION OF THE DRAWING

The invention will be described in detail, by way of example, with reference to the accompanying drawing in which:

FIG. 1 is a pictorial view of the preferred embodiment of the invention;

FIG. 2 is a partial sectional view taken along line 2—2 in FIG. 1;

FIG. 3 is a partial pictorial view of an alternative embodiment of the invention;

FIG. 4 is a partial sectional view taken along line 4—4 in FIG. 3; and FIG. 5 is a pictorial view of the closed box.

DETAILED DESCRIPTION OF THE INVENTION

Referring to FIG. 1 of the drawing and in accordance with the principles of the invention, an artist's kit is shown comprising a rectangular paint box 10 and an easel 12. The box 10 is configured to hold the artist's materials and tools, is rectangular in shape and includes a base 14, a front wall 16, a rear wall 18 and a pair of side walls 20 all disposed substantially perpendicular to the base 14. A cover 22 is connected to the rear wall 18 of the box 10 with hinge members 24 for pivotal movement from a closed position as shown in FIG. 5 to a fully opened position wherein the cover 22 is positioned in a plane that is substantially parallel to the base 14 of the box 10.

The cover 22 comprises a rectangular and planar top member 26 and four side walls 28 a–d all substantially perpendicular to the top member 26 and each corresponding to a wall of the box 10 when closed as shown in FIG. 2. The cover 22 can be releasably locked in either the closed position with latch members 30 and 32 on the box 10 and cover 22 respectively or in the open position by use of at least one locking member 34 having a headed first portion 36 for contacting the inner rear wall **28*a* of the cover 22 and a second portion 38 extending through an aperture 40 in the rear wall 18 of the box 10 and an aligned aperture 42 in the adjacent side wall 28*a*. The second portion 38 of the locking member 34 is threaded to engage with a wing nut 44 to provide a releasable locking device coacting with the locking member 34 to retain the rear wall 18 of the box 10 and side wall 28*a* of the cover between the head 36 and wing nut 44 thereby forming an open top and rigid tray assembly 45**.

In an alternative embodiment shown in FIG. 3, the cover 22 is releasably locked in the full open position by at least one locking member **34*a* each comprising an elongated arm 46 having a longitidinal slot 48 in one end 50 for coacting with a stud 52 affixed to the side wall 28*b* and adapted to slideably mount the arm 46 to the side wall 28*b* of the cover 22 and a pivot aperture 54 in the other end 56 of the arm 46 receptive of a pivot stud 58 affixed to the side wall 20 of the box 10. A locking aperture 60 disposed in the side wall 28*b* is in alignment with a portion of the slot 48 when the cover is in the fully open position. A threaded screw 62 is positioned through the aligned aperture 60 and slot 48 with the screw head disposed with the cover 22 and then locked with a wing nut 64 that is threadedly engageable with the screw 62 to form the rigid tray assembly 45*a***.

Neither of the embodiments described depends upon surface friction to rigidize the tray assembly 45, **45*a*. The tray assembly 45, 45*a* could not collapse unless either wing nut 44, 64 were first removed and the threaded members 34, 62** withdrawn.

As shown in FIG. 1, the rigidized tray assembly 45, 45*a* can then be releasably connected to a commercial easel 12 of the type having at least two front legs 66 and at least one rear leg 68 all resting with one end upon a given ground plane 70. Preferably the side walls 20 of the box are each provided with at least one mounting aperture 72 which are alignable with at least one mounting aperture 74 in each of the front legs 66 of the easel 12. Another mounting aperture 76 is provided in the wall 28*c* of the cover 22 and corresponds to at least one aperture 77 in the rear leg 68. The tray assembly 45, 45*a* is assembled to the easel 12 by passing a pair of screws 78 through each of the mounting apertures 72 in the side wall 20 and through a selected and aligned aperture 74 in the front legs 66. The tray assembly 45, 45*a* is secured with a pair of wing nuts 80 each engaging with the threaded portion of one screw 78.

To secure the rear portion of the tray assembly 45, 45*a*, an L-shaped hook 82 is first received through the mounting aperture 76 in the cover 22 and secured with a nut 84. The hook 82 is positoned to extend outwardly from the tray assembly 45, 45*a* with the leg of the L-shape pointed downward as shown in FIG. 1 for engaging with a portion of the screw 86 which is mounted through the aperture 77 in the rear leg 68 and affixed thereto with a nut.

The location of the various mounting apertures in the easel 12 and tray assembly 45, 45*a* are derived to maintain the tray assembly 45, 45*a* in a position substantially parallel to the ground plane 70 and at a height most suitable for the artist.

The use of the easel 12 to retain the canvas 90 is unaffected by the addition of the tray assembly 45, 45*a* since the connection of the bottom and top canvas clamps 92, 94 is not precluded. Additionally, the rigidity of the opened easel is improved since the tray assembly forms a brace for the legs 66, 68.

An alternative method of mounting the tray assembly 45, 45*a* is shown in FIG. 4. A pair of elongated clamping members 96 are positioned to straddle the pair of front legs 66 of the easel leaving a space 98 therebetween. These members 96 are aligned parallel to the ground plane 70 and each have a pair of aligned mounting holes at end portions thereof to receive screws 99 through both members 96 for clamping to the easel legs 66 when locked with wing nuts 100. With the easel legs 66 properly spaced apart, the tray assembly 45, 45*a* can be placed over the members 96. At least one aperture 102 is provided in the base 14 of the box 10 that can be aligned with the space 98 between the clamping members 96. A locking screw 104 and wing nut 106 hold the forward portion of the tray assembly 45, 45*a*. The rear portion thereof is supported by the L-shaped hook 82 and screw 86 as previously described.

In use, the artist's box 12 and cover 22 are placed in the fully open position and secured therein by using either of the apparatus described to form the flat rigid tray assembly 45, 45*a*. The easel 12 is opened with the three legs 66, 68 set on the ground plane 70. The tray assembly 45, 45*a* is positioned within the confines of the legs 66, 68 and at a selected distance above the given plane 70, the legs 66, 68 adjusted for each to be proximable with the tray assembly 45, 45*a* is releasably clamped using either of the apparatus described. When the canvas 90 is mounted, the unit is complete.

While the preferred and alternative embodiments of the invention are described, it will be understood that the invention is in no way limited by these embodiments.

What is claimed is:

1. An artist's kit for use with a free standing easel of the type commercially available to artists and having at least three leg members configured to rest on a given plane during use for holding an artist's canvas or the like, said kit comprising;

a. a rectangular box for holding artist's materials, said box including a base and a front wall, a rear wall and side walls all substantially perpendicularly disposed with respect to said base;

b. means for covering said box comprising a rectangular shaped cover and means for mounting said cover to said box for pivotal movement between a closed position wherein said cover overlays the walls of said box and a fully opened position wherein said cover is disposed in a plane substantially parallel to the base of said box;

c. means for releasably locking said cover in said fully opened position to define an open top and rigid tray assembly, the releasable locking means including at least one locking member having portions connectable to at least one of one wall of said box and said cover; and d. means for releasably connecting the rigid tray assembly between the leg members of the easel in a plane substantially parallel to the given plane for supporting the artist's materials during use.

2. The artist's kit according to claim 1, wherein said cover includes a planar member and four side walls, with the rear wall of the box adjacent to one side wall of the cover when the cover is in the fully opened position, wherein each locking member has a first portion connectable to the rear wall of the box and a second portion connectable to the adjacent side wall of the cover and wherein the releasable locking means further comprises means coactive with said first and second portions for connecting the rear wall of the box to the adjacent wall of the cover.

3. The artist's kit according to claim 2, wherein the releasable locking means further comprises means defining at least one set of aligned apertures in the rear wall of the box and in the adjacent side wall of the cover and wherein said first portion of said locking member includes a head member for contacting said rear wall of the box and said second portion of said locking means includes a threaded section configured to extend through one aligned set of apertures and the coactive means for connecting includes a wing nut engageable with the threaded section.

4. The artist's kit according to claim 3, wherein the easel has at least two front legs and at least one rear leg, each leg having at least one aperture therein and wherein said means for releasably connecting the tray assembly to the easel includes at least one mounting aperture in each of the side walls of the box and alignable with the mounting apertures in the front legs and a mounting aperture in the wall of the cover opposite said adjacent wall, means receivable through each of the two aligned pairs of mounting apertures for connecting the side walls to the front legs and a first member receivable through the mounting aperture in the opposite wall of said cover and a second member receivable through the rear leg mounting aperture for connecting to the first member.

5. The artist's kit according to claim 4, wherein each of the means receivable through the aligned pairs of apertures comprises a screw and a wing nut engageable therewith and wherein said first member comprises an L-shaped hook member and the second member comprises a screw and wing nut engageable therewith.

6. The artist's kit according to claim 3, wherein the easel has at least two front legs, at least one rear leg having at least one aperture therein, and a clamping device having two elongated and spaced apart clamping members releasably clamping the two front legs therebetween and wherein said meas for releasably connecting the tray assembly to the easel includes at least one mounting aperture in the base of the box and alignable with the mounting space between said clamping members and a mounting aperture in the wall of the cover opposite said adjacent wall, means receivable through the aligned mounting aperture in the base of the box and the space between said clamping members for connecting the box to the clamping device and a first member receivable through the mounting aperture in the opposite wall of said cover and a second member receivable through the rear leg mounting aperture for connecting to the first member.

7. The artist's kit according to claim 6, wherein the means receivable through the aligned mounting aperture in the base of the box and the space between said clamping members comprises a screw and wing nut engageable therewith and wherein said first member comprises an L-shaped hook member and the second member comprises a screw and wing nut engageable therewith.

8. The artist's kit according to claim 1, wherein said cover includes a planar member and four side walls, with the rear wall of the box adjacent to the one side wll of the cover when the cover is in the fully opened position, wherein the releasable locking means comprises on at least one side of the box an elongated pivot arm, means pivotally mounting one end portion of said arm to one of said side walls of said box, means defining a longitudinal slot in said arm, means for slidably mounting said arm to one side wall of said cover corresponding to said one of said side walls of said box and means defining a locking aperture in said one side wall of said cover, said aperture in alignment with said elongated slot when said cover is in the fully opened position, and wherein the releasably locking means further comprises a screw receivable through said aligned locking aperture and said elongated slot and a wing nut engageable with said screw.

9. The artist's kit according to claim 8, wherein the easel has at least two front legs and at least one rear leg, each leg having at least one mounting aperture therein and wherein said means for releasably connecting the tray assembly to the easel includes at least one aperture in each of the side walls of the box and alignable with the apertures in the front legs and an aperture in the wall of the cover opposite said adjacent wall, means receivable through each of the two aligned pairs of apertures for connecting the side walls to the front legs and a first member receivable through the aperture in the opposite wall of said cover and a second member receivable through the rear leg aperture for connecting to the first member.

10. The artist's kit according to claim 9, wherein each of the means receivable through the aligned pairs of apertures comprises a screw and wing nut engageable therewith and wherein said first member comprises an L-shaped hook member and the second member comprises a screw and wing nut engageable therewith.

11. The artist's kit according to claim 8, wherein the easel has at least two front legs, at least one rear leg having at least one aperture therein, and a clamping device having two elongated and spaced apart clamping members releasably clamping the two front legs therebetween and wherein said means for releasably connecting the tray assembly to the easel includes at least one aperture in the base of the box and alignable with the space between clamping members and an aperture in the wall of the cover opposite said adjacent wall, means receivable through the adjacent aperture in the base of the box and the space between the clamping members for connecting the box to the clamping device and a first member receivable through the aperture in the opposite wall of said cover and a second member receivable through the aperture in the rear leg for connecting to the first member.

12. The artist's kit according to claim 11, wherein the means receivable through the aligned aperture in the base of the box and the space between the clamping members comprises a screw and a wing nut engageable therewith and wherein said first member comprises an L-shaped hook member and the second member comprises a screw and wing nut engageable therewith.

* * * * *